United States Patent [19]

De Vos et al.

[11] 4,426,126

[45] Jan. 17, 1984

[54] LIGHTING FIXTURE CONNECTING DEVICE WITH SAFETY MEANS

[75] Inventors: Hendrik A. J. De Vos; Elzear R. Labouliere, both of Swansea, both of Mass.

[73] Assignee: GTE Products Corporation, Stamford, Conn.

[21] Appl. No.: 318,184

[22] Filed: Nov., 1981

[51] Int. Cl.[3] ..... H01R 13/46

[52] U.S. Cl. ..... 339/125 R; 339/197 R; 248/222.2; 248/342; 362/408

[58] Field of Search ..... 339/123, 125 R, 125 L, 339/135, 197 R, 197 B, 122 R, 122 F, 119 R, 119 C, 119 L; 248/27.1, 222.2, 222.3, 342, 343, 344; 362/396, 408

[56] References Cited

U.S. PATENT DOCUMENTS

| | | | |
|---|---|---|---|
| 434,186 | 8/1890 | Jacques et al. | 339/197 R |
| 1,441,279 | 1/1923 | Hammarlund | 248/27.1 |
| 1,595,972 | 8/1926 | De Reamer | 339/122 F |
| 3,064,851 | 11/1962 | Guigli | 292/DIG. 4 |
| 3,705,302 | 12/1972 | Judge et al. | 362/222 |
| 3,798,584 | 3/1974 | Person | 339/122 F |
| 3,985,417 | 10/1976 | Fenton | 339/122 F |
| 4,162,779 | 7/1979 | Van Steenhoven et al. | 248/343 |
| 4,208,702 | 6/1980 | Wotowiec | 339/125 L |
| 4,222,093 | 9/1980 | Garcia et al. | 362/147 |

*Primary Examiner*—John McQuade
*Assistant Examiner*—Gary F. Paumen
*Attorney, Agent, or Firm*—Lawrence R. Fraley

[57] ABSTRACT

A connecting device for securing a vertically suspended lighting fixture to the housing of an electrical junction (wiring) box in such a manner that the lighting fixture can be pivoted to an open position to enable interconnection of the fixture's and junction box's electrical wiring in a safe, facile manner. The device includes a safety means to prevent accidental removal (separation) of the fixture and junction box while in the pivoted, open position. In a preferred embodiment, the invention includes a pair of planar, substantially rectangular plate members. A first of these members is designed for being attached to the junction box and the second for being secured to the lighting fixture. Located on the second plate is a pair of upwardly projecting tab members adapted for being inserted within a corresponding pair of elongated openings located within the first plate member. The safety means is in the form of an upwardly projecting segment located on an upper surface of the first plate, said segment designed for being engaged by one of the projecting tab members during the described, pivoted position of the lighting fixture.

9 Claims, 5 Drawing Figures

LIGHTING FIXTURE CONNECTING DEVICE WITH SAFETY MEANS

DESCRIPTION

1. Technical Field

The invention relates to lighting fixtures and particularly to lighting fixtures of the indoor variety. Even more particularly, the invention relates to means for connecting vertically suspended lighting fixtures to the housing of an electrical junction (wiring) box.

2. Background

Typically, indoor lighting fixtures are physically secured to a corresponding flush or surface mounted junction box in a substantially permanent type arrangement such as by means of screws, bolts, etc. In order to connect (mount) the lighting fixture to the junction box, it is usually necessary to first connect the electrical wiring of the fixture to that wiring found within the box. Thereafter, the installer is required to effect the aforementioned permanent attachment by threading screws, bolts, etc. through threaded openings provided within the junction box. Understandably, this mode of installation can prove both cumbersome and potentially dangerous in view of the need of the installer to simultaneously hold the sometimes heavy fixture while performing the interconnection of the electrical wiring and thereafter the permanent attachment. This procedure is made all the more difficult when considering the high positioning heights and often inaccessible locations where indoor lighting fixtures are often positioned.

It is believed, therefore, that a device for providing connection between a substantially vertically oriented lighting fixture and a corresponding electrical junction box which will enable facile securement of the fixture to the box while at the same time allowing the installer to have access to the fixture and junction box electrical wiring without the possibility of the fixture being accidentally removed (separated from the junction box) would constitute a significant advancement in the art.

DISCLOSURE OF THE INVENTION

It is a primary object of this invention to enhance the lighting fixture art by the provision of a connecting device possessing the unique advantages described above.

It is another object of the invention to provide a connecting device for an indoor lighting fixture which will enable the fixture to be pivotally and removably connected to the corresponding electrical junction box to thus enable the installer to have ready access thereto such that interconnection of the fixture and junction box electrical wiring can be accomplished.

It is still another object of this invention to provide a connecting device possessing the above features wherein safety means is provided to prevent accidental removal (separation) of the fixture when the fixture is positioned in the pivoted, open position during which the aforedescribed interconnection of electrical wiring is performed.

It is an even further object of the invention to provide a connecting device possessing the above features and also assuring ease of insertion and removal of the lighting fixture should replacement and/or repair thereof be necessary.

In accordance with one aspect of the invention, there is provided a device for connecting a substantially vertically oriented lighting fixture to an electrical junction housing wherein the device comprises a first plate member capable of being secured to the junction housing, a second plate member for being secured to the lighting fixture, means for pivotally and removably connecting the second plate to the first plate such that the second plate is able to occupy a first, closed position against the first plate and a second, open position with respect to said first plate, means for detachably securing both the first and second plates when in the first, closed position, and safety means for preventing accidental removal of the second plate from the first plate member (and therefore the fixture from the junction housing) when the second plate member occupies the second, open position.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
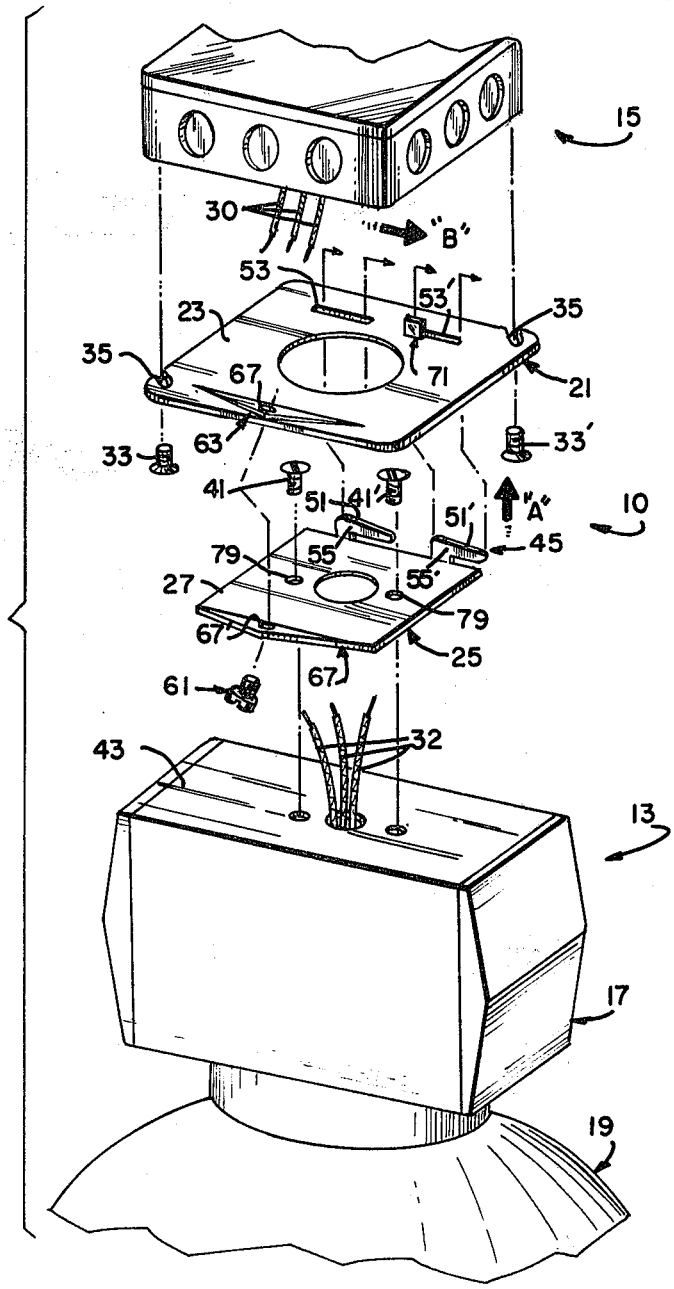
FIG. 1 is an exploded perspective view of a device for connecting a lighting fixture to an electrical junction housing in accordance with a preferred embodiment of the invention.

With particular reference to FIG. 1, there is shown in exploded form a connecting device 10 for connecting a substantially vertically oriented, indoor lighting fixture 13 to the housing 15 of an electrical junction (wiring) box. Such boxes, as is known in the art, are usually flush or surface mounted relative to the corresponding ceiling to which they are attached. Housings for such components are also typically of rectangular, boxlike configuration or may be of the cylindrical variety. It is understood with regard to the invention that the connecting device as described herein may provide attachment to junction box housings of any of the aforedescribed and similar configurations. For illustrative purposes, the housing 15 of the electrical junction box as shown is of rectangular, boxlike configuration.

With further regard to the invention, it is also understood that connecting device 10 is capable of connecting lighting fixtures of several different configurations. Accordingly, the configuration of the lighting fixture 13 as shown is also only for illustrative purposes. Typically, such lighting fixtures include a ballast housing 17 containing therein the electrical operating components for the fixture (e.g., ballast transformer and capacitor), and a reflector or refractor member 19 secured to the ballast housing. Although a boxlike housing 17 is shown, such members are also typically of other configurations (e.g., cylindrical).

Connecting device 10 comprises a first plate member 21 having a substantially planar, rectangular main body portion 23, and a second plate member 25 which is also substantially planar and includes a main body portion 27 substantially rectangular configuration somewhat smaller in total area than that of the body portion 23 of plate member 21. By way of specific example, body portion 23 in one embodiment as depicted in FIG. 1 was substantially square, having sides slightly larger than four inches (e.g., 4.06 inches) while the body portion 27 of corresponding plate member 25 possessed a width of about 2.25 inches and a length of about 2.55 inches. Overall (including the projecting tab members and angled segment described below), plate 25 possessed a total length of about 3.33 inches. It is to be understood with regard to the invention, however, that the aforedescribed plate members 21 and 25 may assume other configurations than those shown and described. More specifically, in the event that a cylindrically shaped junction box housing is employed, first plate member 21 (and preferably the second plate member 25 also) would be substantially round in configuration. Plate members 21 and 25 are preferably metallic (e.g., No. 16 ga. cold rolled steel, having a thickness of about 0.059 inch).

Figure 5:
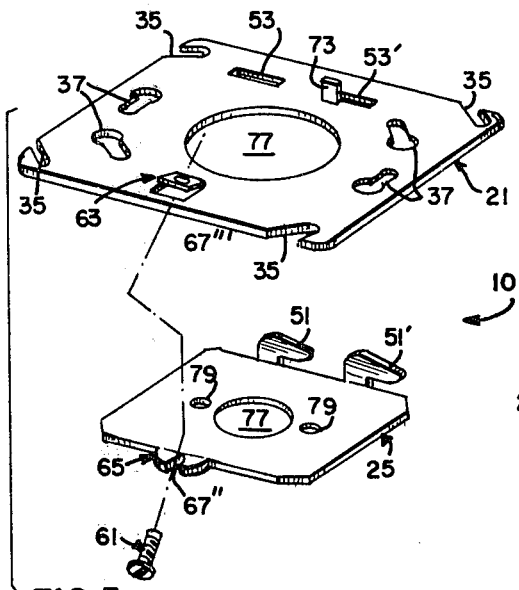
FIG. 5 illustrates a connecting device in accordance with an alternate embodiment of the invention.

Understandably, the function of connecting device 10 is to join the ballast housing 17 of fixture 13 to the electrical junction housing 15. As will be described below, the invention is unique in that it enables fixture 13 to be both detachably secured to housing 15 while still being capable of pivoted with respect thereto and readily removed therefrom to thus enable both interconnection of the electrical wiring (30 from housing 15 and 32 from fixture 13) in the pivoted, open mode and subsequent, ready removal (separation) of these components when oriented in a non-open (closed) mode. Accordingly, the planar first plate member 21 is adapted for being positively secured (e.g., using screws 33, 33') to the bottom surface of housing 15. Ease of securement is assured by the provision of corresponding, elongated slots within the corners of plate 21, with screws 33 and 33' passing therethrough and being threaded into housing 15. Although only two slots 35 are shown, it is within the scope of the invention to provide these openings at other locations (e.g., at the remaining, non-slotted corners) such as illustrated in FIG. 5. As further illustrated in FIG. 5, it is also possible to provide the first plate member with additional holes (e.g., such as key holes 37) in order that this member may be universally adaptable to the majority of junction box housing configurations presently utilized today. Second plate 25 is designed for being secured (e.g., by screws 41, 41') to a planar, upper surface 43 of ballast housing 17.

Figure 2:
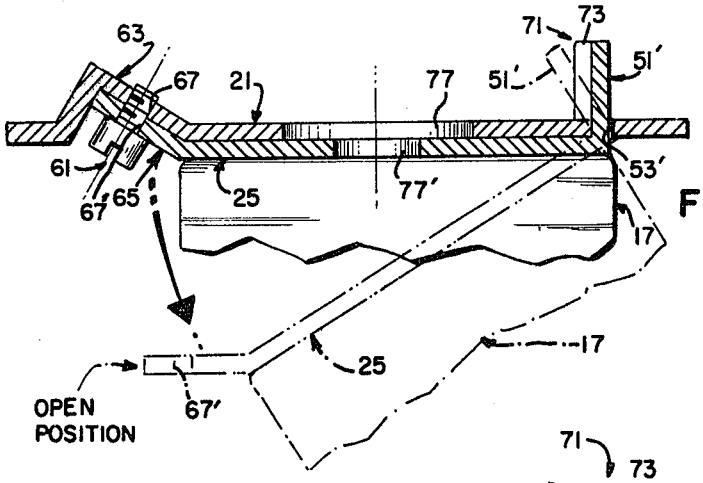
FIG. 2 is an enlarged, sectional view of the first and second plate members of the invention, illustrating both the closed and open positions of the second plate member.
Figure 3:
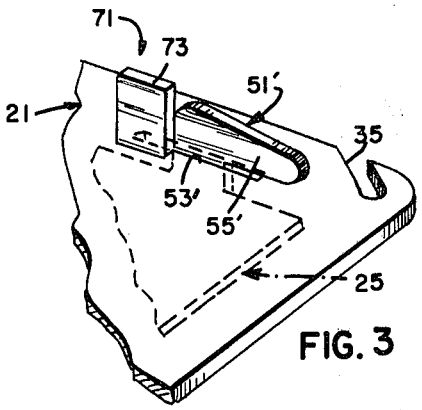
FIGS. 3 and 4 are enlarged, partial perspective views illustrating the safety means of the invention during the aforedescribed closed and open positions, respectively.

Connecting device 10 further comprises means 45 for pivotally and removably connecting second plate 25 to plate 21 such that the second plate 25 is able to occupy a first, closed position with respect to plate 21 (shown in solid in FIG. 2), and thereafter a second, open position at a predetermined angle from the first plate 21 (shown in phantom in FIG. 2). Means 45 comprises a pair (two) of L-shaped, projecting tab members 51 and 51' which project upwardly and perpendicularly from the planar second plate 25. Each of these tab members may form an extension of the steel plate member 25 or may be secured (e.g., welded) thereto. Each tab is designed for being inserted upwardly and therefor in a first direction ("A") within a corresponding pair of elongated openings 53 and 53' positioned within first plate 21 in the end-to-end relationship depicted. Once fully inserted upwardly within the corresponding elongated openings, plate 25 can be then moved in a substantially horizontal direction ("B") such that the extending tip portions 55 and 55' of tabs 51 and 51', respectively, slidably engage the upper surface of first plate 21 (FIG. 3). It can therefore be seen that with plate 25 in its fully inserted position at this hinged location, separation of both plates 21 and 25 (and therefore fixture 13 from housing 15) can not be achieved until plate 25 is moved in the reverse direction (opposite direction "B").

Figure 4:
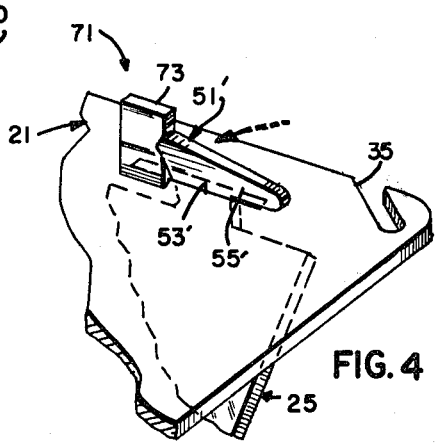

With tabs 51 and 51' fully inserted within openings 53 and 53', respectively, detachable securement of the first plate 25 to second plate 21 is provided by means 61. Specifically, both first and second plate members 21 and 25 include an angled segment (63 and 65, respectively) which are designed for mating in an abutting relationship when first second plate 25 occupies the fully closed position as shown in solid in FIG. 2. Each upwardly angled segment 63 and 65 in turn includes a hole (67 and 67', respectively) which are coaxially aligned in the illustrated, closed position. Thereafter, a screw member 61 is inserted to lock the two members 21 and 25 together. In this arrangement, it is preferred that hole 67 be threaded and screw member 61 in turn threaded therein. Although one is not shown, it is also within the scope of the invention to utilize a washer to assure added securement of the described plate members. With particular regard to FIG. 2, it can be seen that the aforedescribed angled segments are such that the final angular relationship of screw member 61 is such that insertion and removal thereof can be facilely accomplished using a standard implement, such as a screwdriver. That is, screw 61 is oriented in such a manner that the screwdriver may be utilized without interfering with the upstanding sides of ballast housing 17 (shown in FIG. 2). It can thus be seen that second plate 25 can be readily detached at one side thereof from the corresponding first plate member 21 to thereafter enable the second plate to pivot to the shown open position whereupon interconnections of wiring 30 and 32 can be achieved. In addition, this pivoted, open position enables the installer/repairperson to effect separation of wiring 30 and 32 and thereafter remove (separate) lighting fixture 13 from housing 15. It is absolutely essential, however, that while the second plate member 25 is oriented in the aforedescribed open, second position that fixture 13 will not accidentally fall and possibly injure the installer/repairman. To prevent such an occurrence, the invention further includes a safety means 71 for preventing separation of first and second plate members 21 and 25 respectively when said members are detached at their respective angular segments (63, 65) and oriented in the described open, angular orientation. Safety means 71 comprises an upstanding, projecting segment 73 of planar, rectangular configuration which is secured to or forms part of first plate 21 in the manner shown in FIGS. 3 and 4. Segment 73 is perpendicularly oriented on the upper surface of plate 25 and is positioned relative to and immediately adjacent one end of one (53') of the elongated openings designed to accommodate a respective one of the aforedescribed projecting tab members of plate 25. As shown in FIG. 4, the end surface of corresponding tab member 51' nearest segment 13 engages the corresponding end surface of segment 73 when plate 25 is pivoted to the second, open position to in turn prevent movement of plate 25 in a direction opposite that of its original insertion (direction "B"). In effect, segment 73 locks tab 51' and therefore plate 25 in its fully inserted position during the corresponding open orientation shown. This relatively simple and unique safety means has proven to positively maintain the corresponding plate members in the desired hinged orientation to prevent accidental separation thereof and possible harm to a person installing, repairing, and/or removing lighting fixture 13.

Although only one projecting segment 73 has been shown and described, it is also within the scope of the invention to utilize one of these members for each of the corresponding projecting tab members employed. With regard to the invention, however, a singular segment 73 has proven fully capable of successfully attaining the results desired. Should another segment 73 be desired, however, this additional member would be positioned at the end of and immediately adjacent the remaining, elongated opening (53).

With added reference to FIG. 2, it can be seen that each plate member 21 and 25 further includes a substantially centrally positioned wire passage aperture (77 and 77', respectively) to allow passage of wiring 30 and 32 therethrough. It can also be seen in FIG. 2 that aperture 77', being round, is of a smaller diameter than the aperture 77, and that both apertures are coaxially oriented when plate members 21 and 25 are positioned in the first, closed position shown. Use of a smaller aperture 77' allows for positioning of holes (79 in FIG. 1) immediately adjacent thereto in the pattern shown such that when the retention screws 41 and 41' are fully inserted therein, said screws will be oriented within the larger opening 77 during the described, closed position. This positioning relationship allows for use of screws 41 and 41' having head portions which project above the upper surface of second plate 25 such that said head portions will not interfere with the first plate 21 during closure of the corresponding second plate.

With particular regard to FIG. 5, there is illustrated a connecting device 10' in accordance with an alternate embodiment of the invention. In addition to the provision of the aforedescribed keyhole openings 37 and the additional corner slots 35, connecting device 10' differs from that shown in FIG. 1 primarily with regard to the angular segments forming part of the detachable securement means of the invention. More specifically, each angular segment is in the form of an angular positioned tab member, each of these members having a corresponding hole or slot therein to accommodate the described retention screw member 61. As specifically shown in FIG. 5, a slot 67'' is formed within the angular tab 65 of second plate 25, said slot aligning with the corresponding hole 67''' located within the angular tab 63 of first plate 21. With further regard to this particular aspect of the invention, it is understood that the term hole is also meant to include slotted openings of the type shown in FIG. 5.

There has thus been shown and described a device for connecting a vertically suspended lighting fixture to a housing of an electrical junction box in such a manner that the fixture can be pivoted away from the box to enable repair, electrical wiring interconnection, etc., without fear of accidental separation of these members. The device as described is relatively simple in configuration and can therefor be produced at relatively low cost. The device is also adaptable to fixtures and junction boxes of several different configurations. In addition, the device as described allows for connecting of the lighting fixture and junction housing in a simple and effective manner without the need for complicated tooling components.

While there have been shown and described what are at present considered the preferred embodiments of the invention, it will be obvious to those skilled in the art that various changes and modifications may be made therein without departing from the scope of the invention as defined by the appended claims. For example, it is possble in the invention to utilize but a singular projecting tab member on second plate 25 and still attain the desired hinged effect. Such a member could also be of different configuration than the L-shaped embodiment as illustrated.

What is claimed is:

1. A device for connecting a substantially vertically oriented lighting fixture to an electrical junction housing, said device comprising:

a first plate member for being secured to said electrical junction housing and including at least one elongated opening therein;

a second plate member for being secured to said lighting fixture and for being removably connected to said first plate member, said second plate member including at least one projecting tab member located thereon or forming part thereof and adapted for being inserted within said elongated opening of said first plate member in a first direction and thereafter moved in a second direction to engage said first plate member, said second plate member adapted for occupying a first, closed position against said first plate member and for pivoting to a second, open position located at a predetermined angle from said first plate member;

means for detachably securing said first and second plate members when said second plate member occupies said first, closed position against said first plate member, and safety means for preventing accidental removal of said second plate member from said first plate member when said second plate member occupies said second, open position with respect to said first plate member, said safety means including a projecting segment located on or forming part of said first plate member, said tab member engaging said projecting segment when said second plate member occupies said second open position to prevent said tab member from moving in a direction substantially opposite to said second direction.

2. The connecting device according to claim 1 wherein said first plate member is substantially planar and of a substantially rectangular configuration.

3. The connecting device according to claim 2 wherein said second plate member is substantially planar and of a substantially rectangular configuration.

4. The connecting device according to claim 3 wherein said first and second plate members each include a wire passage aperture therein, said apertures being aligned with each other when said second plate member occupies said first, closed position with respect to said first plate member.

5. The connecting device according to claim 3 wherein said means for detachably securing said first and second plate members comprises a screw member for being positioned through a first hole located within said second plate member and threaded into a second hole located within said first plate member.

6. The connecting device according to claim 5 wherein said first and second plate members each include an angled segment, said angled segments being oriented in an abutting relationship when said second plate member occupies said first, closed position, said first hole located within said second plate member being positioned within said angled segment of said second plate member, and said second hole located within said first plate member being positioned within said angled segment of said first plate member.

7. The connecting device according to claim 1 wherein said second plate member is substantially planar, said projecting tab member projecting in a substantially perpendicular manner from said second plate member.

8. The connecting device according to claim 1 wherein the number of said elongated openings is two and the number of said projecting tab members is two, each of said tab members adapted for being inserted with a respective one of said elongated openings to effect said engagement with said first plate member.

9. The connecting device according to claim 1 wherein said first plate member is substantially planar, said projecting segment projecting substantially perpendicular from said first plate member.

* * * * *